US006604290B1

(12) United States Patent
Hughes, Jr.

(10) Patent No.: US 6,604,290 B1
(45) Date of Patent: Aug. 12, 2003

(54) SIDEREAL SUNDIAL

(76) Inventor: Thomas R. Hughes, Jr., 1166 Shattuck Ave., Berkeley, CA (US) 94707

( * ) Notice: Subject to any disclaimer, the term of this patent is extended or adjusted under 35 U.S.C. 154(b) by 0 days.

(21) Appl. No.: 10/067,063

(22) Filed: Feb. 4, 2002

(51) Int. Cl.[7] ..... G04B 49/02
(52) U.S. Cl. ..... 33/270
(58) Field of Search ..... 33/1 E, 268, 269, 33/270, 271; 368/79

(56) References Cited

U.S. PATENT DOCUMENTS

| | | | | | |
|---|---|---|---|---|---|
| 2,192,750 | A | * | 3/1940 | Mead | 33/270 |
| 2,696,053 | A | | 12/1954 | Royt | 33/270 |
| 3,052,986 | A | | 9/1962 | Merchant | 33/269 |
| 3,486,234 | A | * | 12/1969 | Waterman | 33/270 |
| 3,786,570 | A | * | 1/1974 | Davies | 33/270 |
| 3,815,249 | A | * | 6/1974 | Gundlach | 33/269 |
| 3,940,859 | A | | 3/1976 | Troseth | 33/270 |
| 4,050,161 | A | * | 9/1977 | Yabashi | 33/270 |
| 4,102,054 | A | * | 7/1978 | Lewis | 33/270 |
| 4,103,429 | A | * | 8/1978 | Wagoner | 33/270 |
| 4,237,611 | A | * | 12/1980 | Wurch et al. | 33/271 |
| 4,922,619 | A | * | 5/1990 | Singleton | 33/270 |
| 5,459,931 | A | * | 10/1995 | Waltho | 33/271 |
| 5,701,678 | A | * | 12/1997 | Wang | 33/268 |

FOREIGN PATENT DOCUMENTS

| | | | |
|---|---|---|---|
| DE | 2939822 A1 | * | 3/1981 |
| GB | 2193351 A | * | 2/1988 |
| JP | 403010193 A | * | 1/1991 |
| WO | WO 8900720 | * | 1/1989 |
| WO | WO 9725655 | * | 7/1997 |

OTHER PUBLICATIONS

"Bifilar Gnomonics", Frederick W. Sawyer.

*Journal of the British Astronomical Association*, Jun. 1978, 88(4):334–351.

*Bulletin of the British Sundial Society Society*, Feb. 1993, 93(1):36–44, also Feb. 1995, 95(1):18–27.

"An Ecliptic Demonstrator", A. Parkin, *Sky & Telescope*, Apr. 1992, pp. 365–366.

*Journal of the North American Sundial Society* a.k.a. *The Compendium* Sep. 1998, vol.5, No. 3 pp. 25–29 "Sundials With Conical Gnomons For Sidereal Time", J.M. Bores.

Pp. 29–31 "A Sundial For Sidereal Time", R.J. Vinck.

* cited by examiner

*Primary Examiner*—Diego Gutierrez
*Assistant Examiner*—Madeline Gonzalez

(57) ABSTRACT

By adding an opaque ecliptic half-plane (24) to a partially open or transparent equatorial disk (12) which bears a sidereal hours scale (20), and by being able to rotate this plane (24) and disk (12) jointly in order to minimize the shadow being cast (74) by ecliptic half-plane (24), one can easily determine the local sidereal time using the sun. Understanding its operation draws on a number of basic concepts that a beginning astronomy student should master, and should also interest sundial enthusiasts.

1 Claim, 8 Drawing Sheets

SIDEREAL SUNDIAL

FEDERALLY SPONSORED RESEARCH

Not Applicable

SEQUENCE LISTING OR PROGRAM

Not Applicable

BACKGROUND

1. Field of Invention

This invention relates to a sundial, specifically to a modified equatorial sundial, which gives sidereal time, i.e. star time, as well as solar and watch time.

2. Description of Prior Art

At least two classes of sundials giving sidereal time have been described in the literature. They differ dramatically from each other and from my proposed sidereal sundial. H. Michnik introduced the bifilar type, which uses the intersection of the shadows cast by two crossed threads upon a dial face, in Astronomische Nachrichten, 216, 441 (1922). F. Sawyer has elaborated on Michnik's work in three articles on "Bifilar Gnomonics" published in the Journal of the British Astronomical Association, June 1978, 88(4): 334–351 and in Bulletin of the British Sundial Society, February 1993, 93(1): 36–44, and February 1995, 95(1): 18–27. His sundial requires the use of a separate complex printed map of hour lines for determining sidereal time. A typical beginning astronomy student would not understand why a bifilar sundial functions the way it does or follow the mathematics used to describe its construction.

J. Bores has proposed a sidereal sundial with a conical gnomon that casts a shadow on yet another maze of sidereal hour lines ("Sundials With Conical Gnomons For Sidereal Time" in Journal of the North American Sundial Society, September 1998, Vol 5, No 3, pp. 25–29). Again, a student would not understand either the basis of operation or the mathematics involved.

And, finally, R. Vinck has briefly described yet another sidereal sundial using a conical gnomon in "A Sundial For Sidereal Time" *ibid*, pp. 29–31; however its theoretical basis and operation are not clearly presented.

The most relevant prior art is a letter by A. Parkin in *Sky & Telescope* magazine, Apr. 22, 1992, pp. 365 & 366. Parkin shows an ecliptic disk mounted on a rotatable gnomon that is used to illustrate the existence of the ecliptic plane when this disk casts a thinnest shadow. But this is as far as Parkin went; he did not introduce an equatorial disk or seek to determine sidereal time.

Objects and Advantages

Accordingly, several objects and advantages of my sidereal sundial are:

(a) to provide a simple apparatus, using a rod for a gnomon, that is easy to understand and operate for determining sidereal time using the sun;

(b) to require a minimum amount of mathematics to understand its construction, setting, or operation;

(c) to provide a demonstration apparatus suitable for a beginning astronomy course;

(d) to create a new type of sundial based on the classic equatorial sundial.

SUMMARY

My sidereal sundial is a modified equatorial sundial, with an opaque ecliptic plane mounted at an angle of 23.4° with respect to an equatorial plane. Rotating these planes jointly to minimize the shadow being cast by the ecliptic plane yields the location of the vernal equinox and by extension, the local sidereal time.

DRAWINGS

Drawing Figures

REFERENCE NUMERALS IN DRAWINGS

Figure 1:
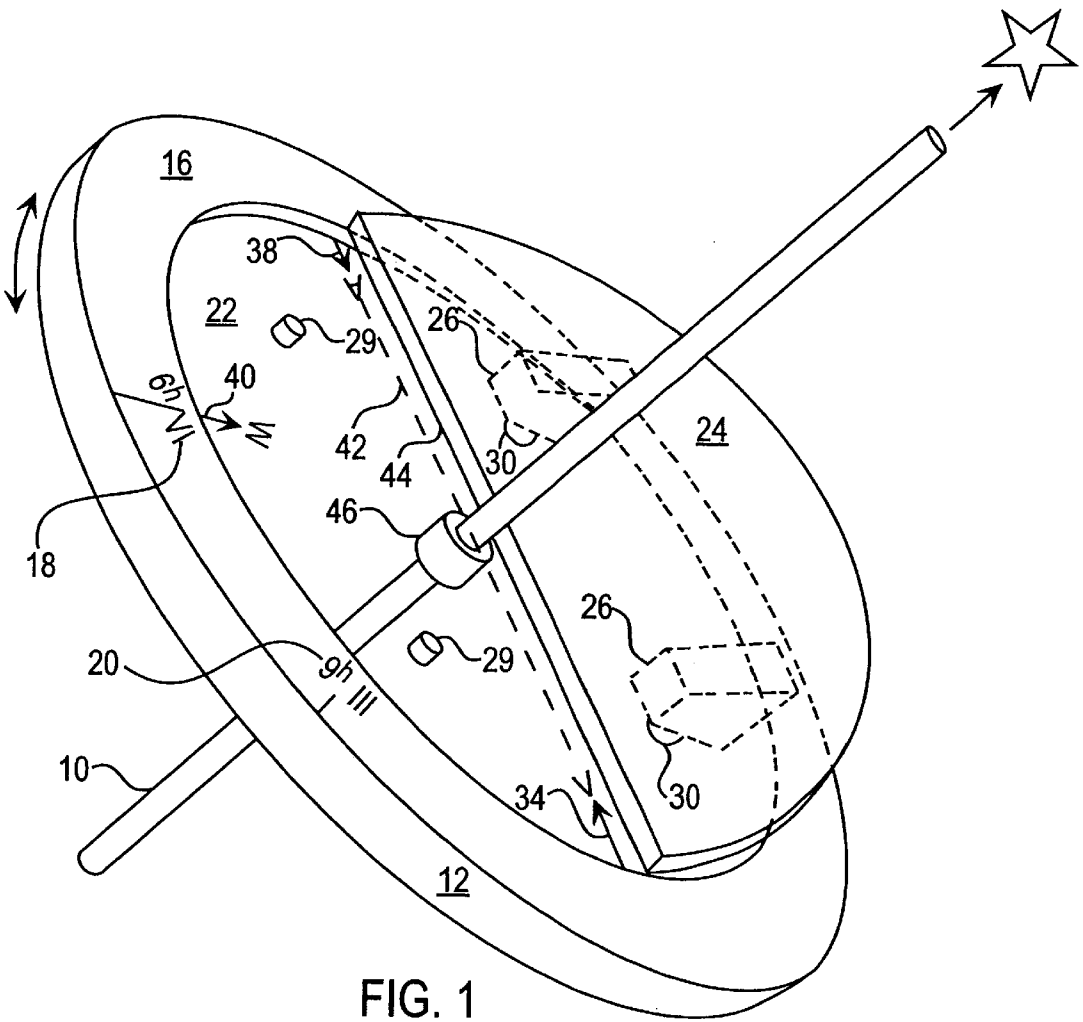
FIG. 1 is an isometric view of the jointly rotatable equatorial and ecliptic planes mounted on a gnomon.

10 gnomon
12 equatorial disk
16 north-facing equatorial scale
18 Roman font solar/watch hours on north-facing equatorial scale 16
20 Arabic font sidereal hours
21 two-minute marks that extend completely around both equatorial scales 16 and 32
22 transparent portion of equatorial disk 12
24 opaque ecliptic half-plane
26 23.4° wedge
28 hole for mounting wedge 26 during fall and winter
29 hole for mounting wedge 26 during spring and summer
30 screw for mounting wedge 26
32 south-facing equatorial scale
33 Roman font solar/watch hours on south-facing equatorial scale 32
34 sun's incoming rays on the vernal equinox
35 spring quadrant
36 sun's incoming rays on the summer solstice
37 summer quadrant
38 sun's incoming rays on the autumnal equinox
39 fall quadrant
40 sun's incoming rays on the winter solstice
41 winter quadrant
42 reference line for spring and summer alignment of ecliptic half-plane 24
44 reference line for fall and winter alignment of ecliptic half-plane 24
46 locking collar
48 set screw
50 gnomon support
52 latitude scale (0 to 90°)
53 half-degree latitude marks extending from 0 to 90° along latitude scale 52
54 rectangular clear plastic base
56 omni directional level
58 leveling screw with protective foot
60 arc-shaped groove to receive gnomon support 50
61 latitude index mark
62 set screw
63 grid detail

64 friction pad
65 backing for compensations plot 70
66 a grid with axes and labeling on underside of base 54
67 bottom plate
68 hole for mounting bottom plate 67
69 threaded hole for mounting bottom plate 67
70 compensations plot with vertical alignment marks
71 mounting screws
72 lower meridian indicator
74 thinnest shadow cast by opaque ecliptic half-plane 24 on any convenient nearby surface.

DETAILED DESCRIPTION

Description of Preferred Embodiment

Figure 8:
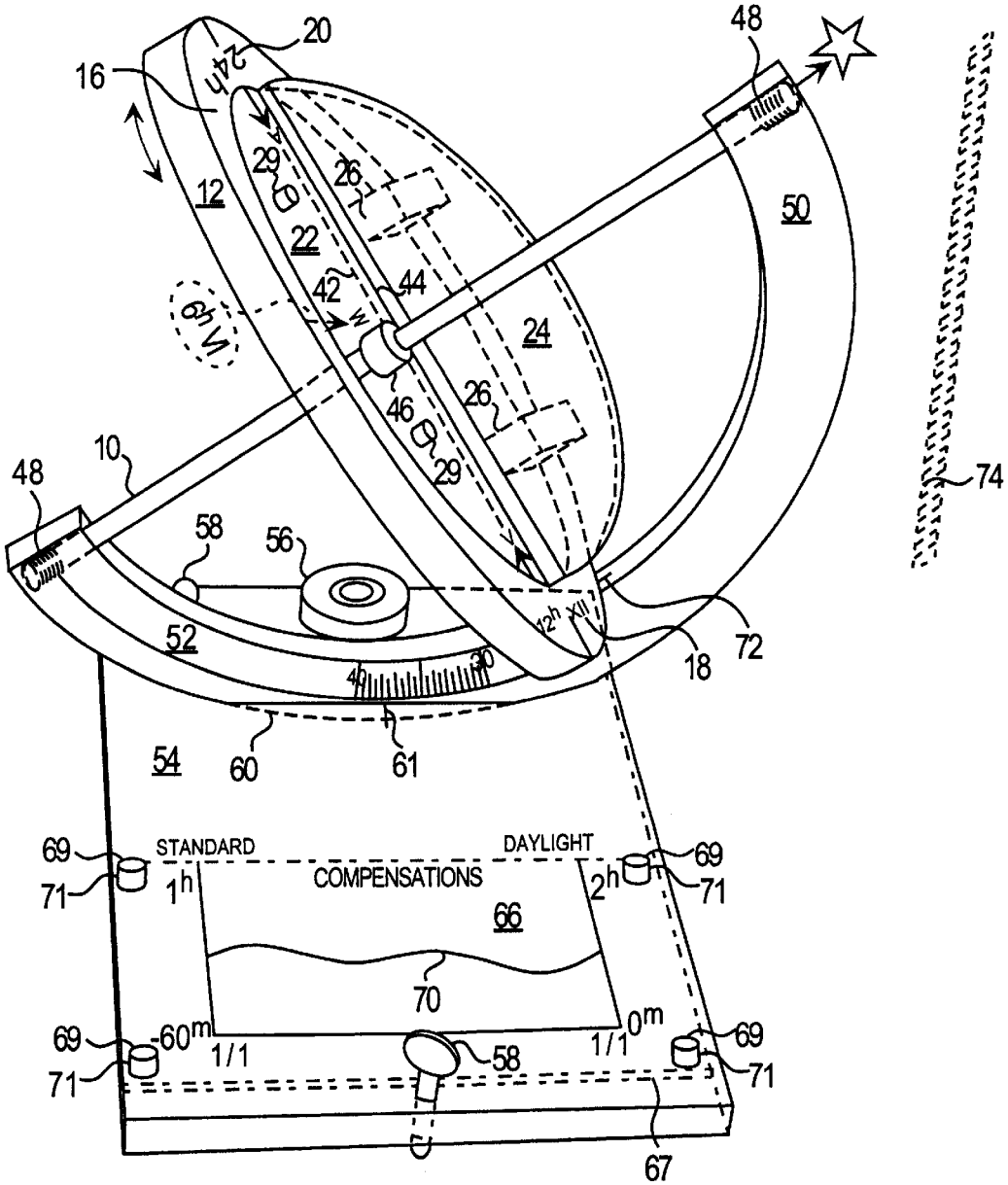
FIG. 8 is an isometric view of the entire sidereal sundial complete with the ecliptic plane's shadow.

FIG. 8 shows the completely assembled sidereal sundial and will be discussed in further detail below. A gnomon 10 must be aligned parallel with the Earth's axis by the user. An equatorial disk 12 is mounted perpendicular to gnomon 10. An opaque ecliptic half-plane 24 is mounted on the north- or south-facing side of equatorial disk 12 and makes an angle of 23.4° with disk 12. The disk 12 and ecliptic plane 24 can rotate jointly about gnomon 10.

FIG. 1 shows gnomon 10, ecliptic plane 24, and two wedges 26 holding ecliptic plane 24 at an angle of 23.4° relative to equatorial disk 12. A north-facing equatorial scale 16 and a south-facing equatorial scale 32 (see FIG. 2) are opaque so that the shadow of gnomon 10 can be seen on them when the dial is being used as a conventional sundial. However, an inner portion 22 of equatorial disk 12 is transparent so that parallel rays of sunlight can pass through inner portion 22 and fall on opaque ecliptic half-plane 24. Two mounting holes 28 (see FIG. 3) are used for mounting wedges 26 during the fall and winter, and two mounting holes 29 are used during the spring and summer. In this preferred embodiment, ecliptic half-plane 24 is always mounted on the face of equatorial disk 12 that is opposite to that face which is first struck by the sun's rays. This enables the sidereal sundial to operate as a conventional equatorial sundial; otherwise, opaque ecliptic half-plane 24 would interfere with the shadow being cast by gnomon 10 on equatorial scales 16 or 32 (see FIG. 2). Since the two faces of transparent region 22 of equatorial disk 12 are parallel, they displace but do not bend the sun's rays. As a consequence, opaque ecliptic half-plane 24 can function as detailed below. North-facing equatorial scale 16 indicates solar or watch hours clockwise in a Roman font 18 and sidereal hours counterclockwise in an Arabic font 20.

Figure 2:
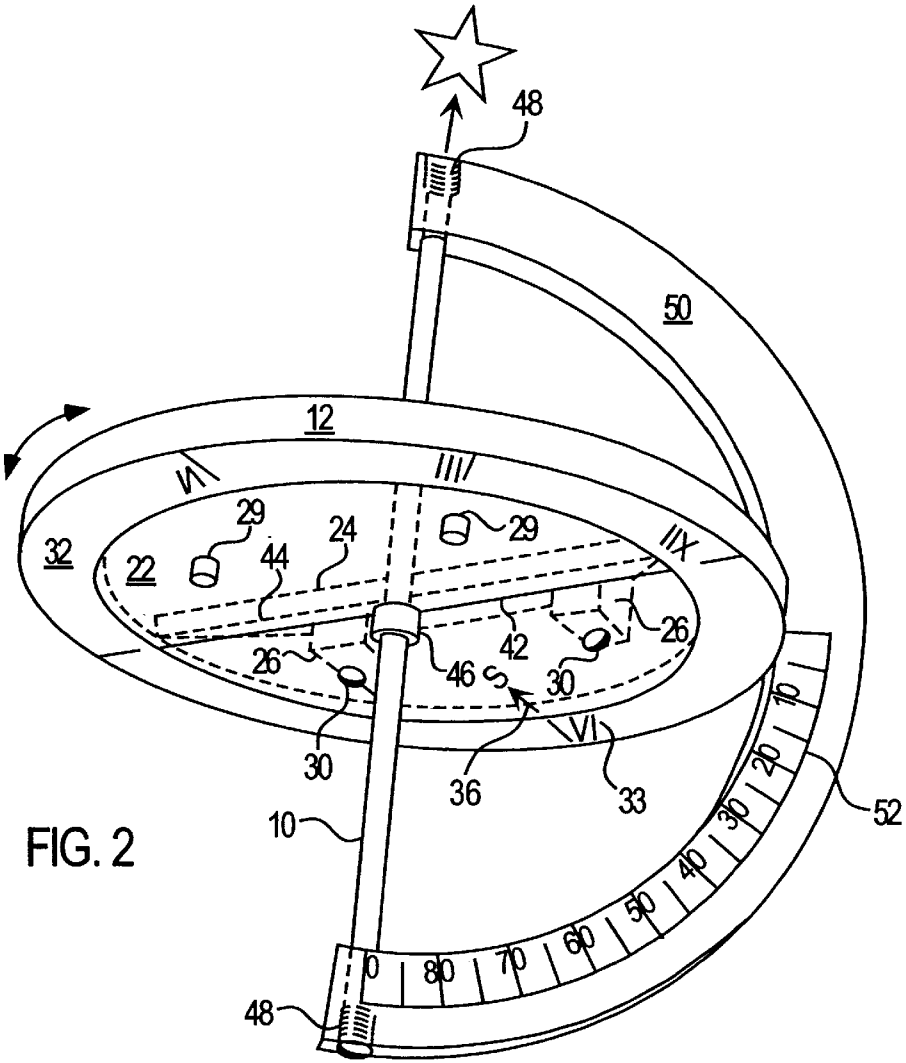
FIG. 2 is a roughly north-facing view of the complete gnomon assembly.

FIG. 2 shows both wedges 26 and their mounting screws 30. A reference line 44 needed for aligning ecliptic half-plane 24 during the fall and winter lies along a diameter on the north-facing side of inner portion 22 of equatorial disk 12 and would pass through XII o'clock if extended (see also FIG. 3). A reference line 42 is used for the same purpose during the spring and summer. Reference line 42 lies along a diameter on the south-facing side of inner portion 22 of equatorial disk 12, and if extended it would also pass through XII o'clock but on the south face of equatorial disk 12 (see also FIG. 4). FIG. 2 also shows a gnomon support 50 with its attached latitude scale 52. Finally, there is a locking collar 46 holding equatorial disk 12 in position on gnomon 10 and setscrews 48 holding gnomon 10 in support 50.

Figure 3:
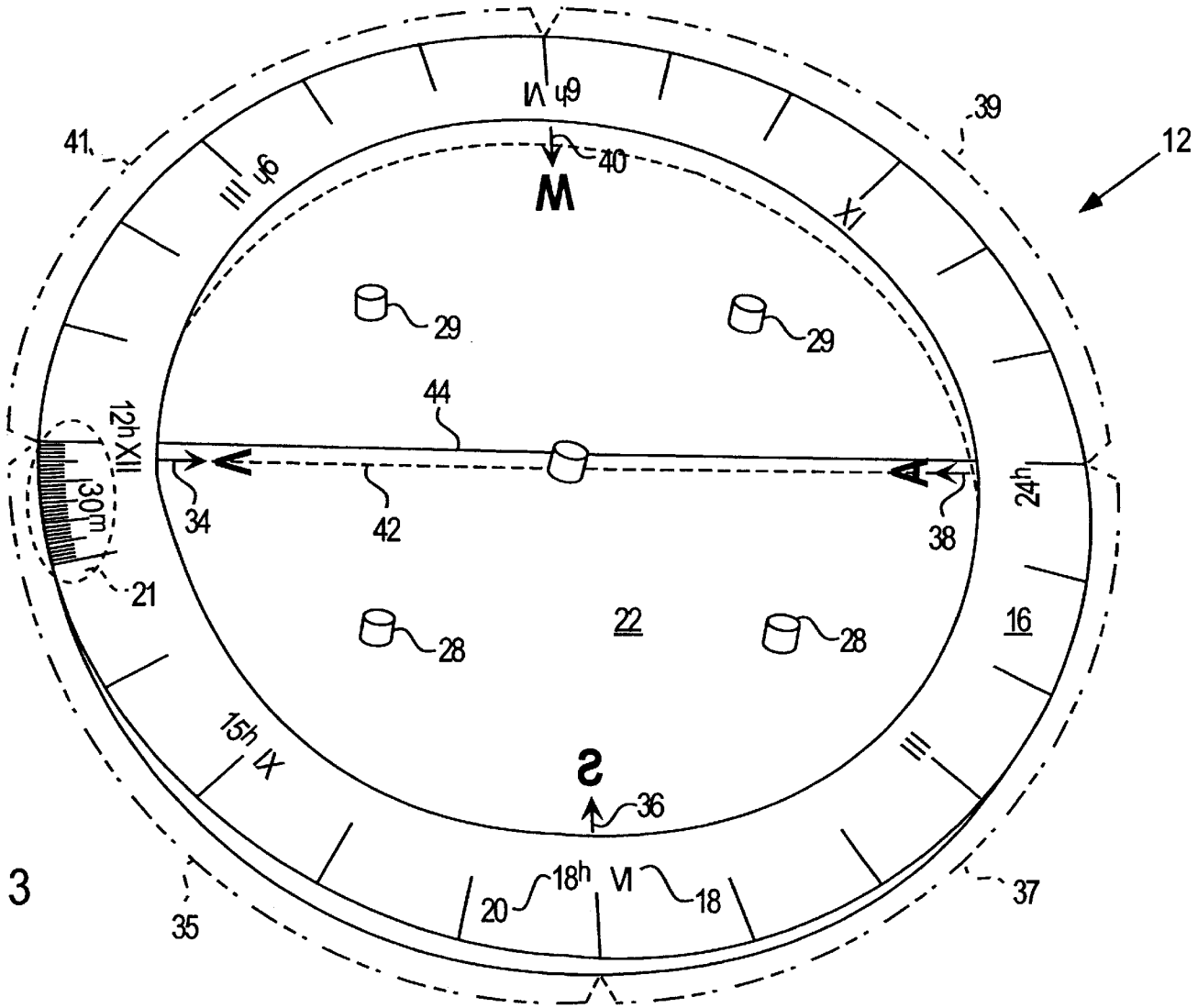
FIG. 3 is a view of the north face of the equatorial disk.

FIG. 3 shows north-facing equatorial scale 16. The Roman font solar/watch hours 18 increase in the clockwise direction and the Arabic font sidereal hours 20 increase in the counterclockwise direction. An arrow+V 34 denotes the direction of incoming solar rays on the vernal equinox. Similarly an arrow+S 36 (see also FIG. 4) on the south face of equatorial disk 12 denotes the incoming rays on the summer solstice, an arrow+A 38 denotes the incoming rays on the autumnal equinox, and an arrow+W 40 denotes the incoming rays on the winter solstice. Note that four quadrants spring 35, summer 37, fall 39, and winter 41 for incoming sun's rays are also indicated in FIG. 3. Also note that a series of two-minute marks 21 extend completely around equatorial scale 16. Finally, note that FIG. 3 seems to imply that the right ascension of the vernal equinox is 12 hours, not 0 hours. This is because the preferred embodiment of the sidereal sundial is equipped with a lower meridian indicator 72 (see FIGS. 8 & 9) rather than some form of an upper meridian indicator, thereby avoiding the unnecessary shadow that would be cast by an upper meridian indicator.

Figure 4:
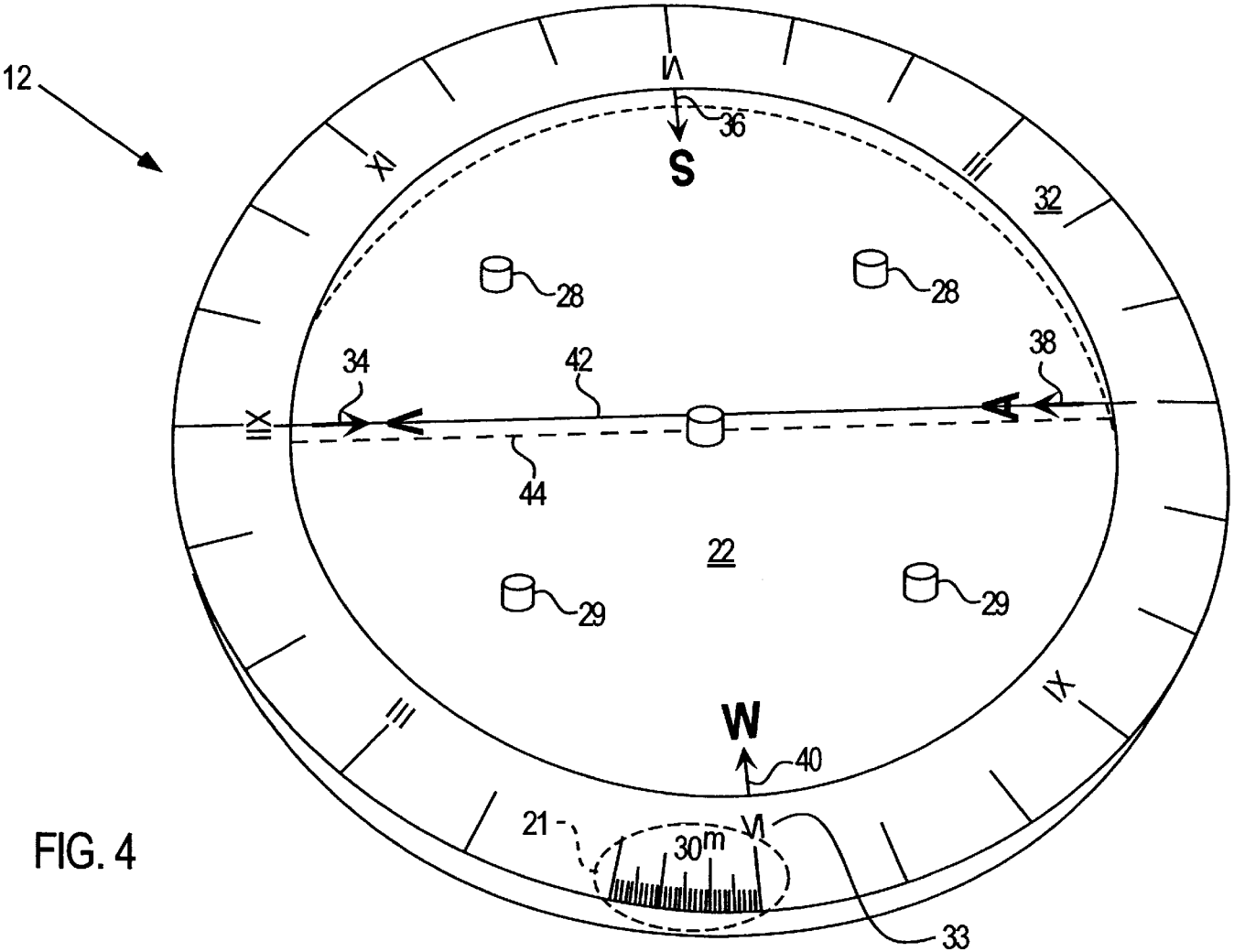
FIG. 4 is a view of the south face of the equatorial disk.

FIG. 4 shows south-facing equatorial scale 32. XII o'clock on this scale 32 corresponds to XII o'clock on north-facing equatorial scale 16 shown in FIG. 3. However, on this scale Roman font solar/watch hours 33 and two-minute marks 21 both increase in the counterclockwise direction, and there are no Arabic hours.

Figure 5:
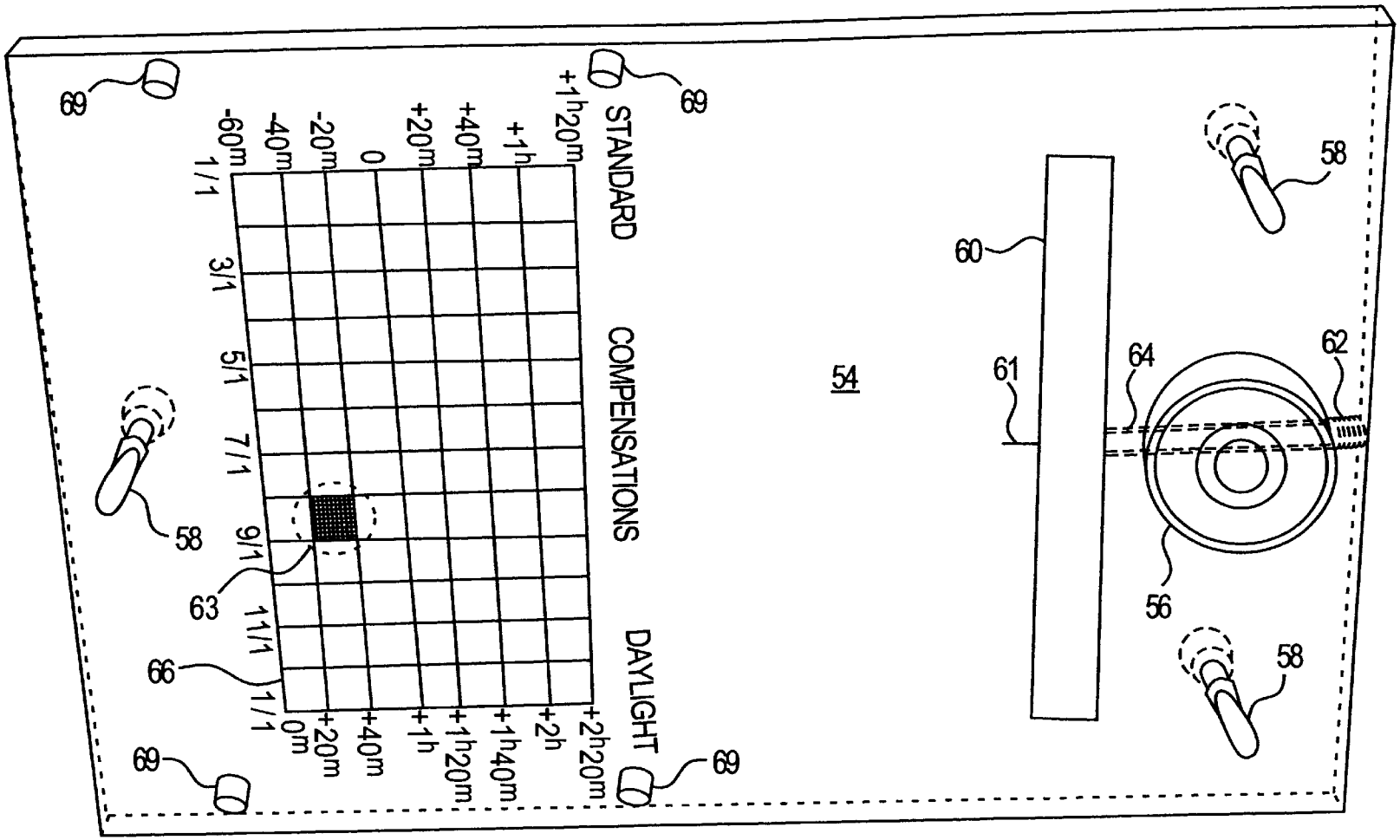
FIG. 5 is an isometric view of the base.

FIG. 5 shows a rectangular clear plastic base 54. Each of three leveling screws 58 has a protective foot so the surface being used will not be damaged. An omni directional level 56 indicates when the sidereal sundial is indeed level. An arc-shaped groove 60 (also see FIG. 8) is cut to receive support 50 (again see FIG. 8), and a latitude index mark 61 is used when setting support 50 for one's latitude. A setscrew 62 and a friction pad 64 can then be used to lock support 50 in position. FIG. 5 also shows a grid with axes and labeling 66 and a grid detail 63 on the underside of base 54. Four threaded holes 69 are used for mounting a bottom plate 67 (see FIG. 7).

Figure 6:
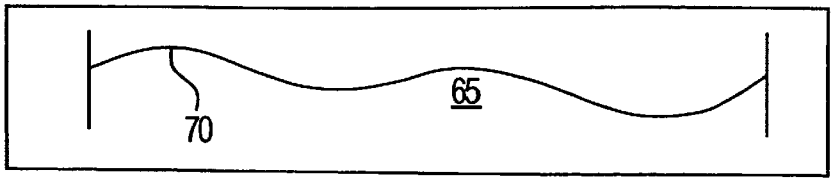
FIG. 6 is a plan view of the compensations plot.
Figure 7:
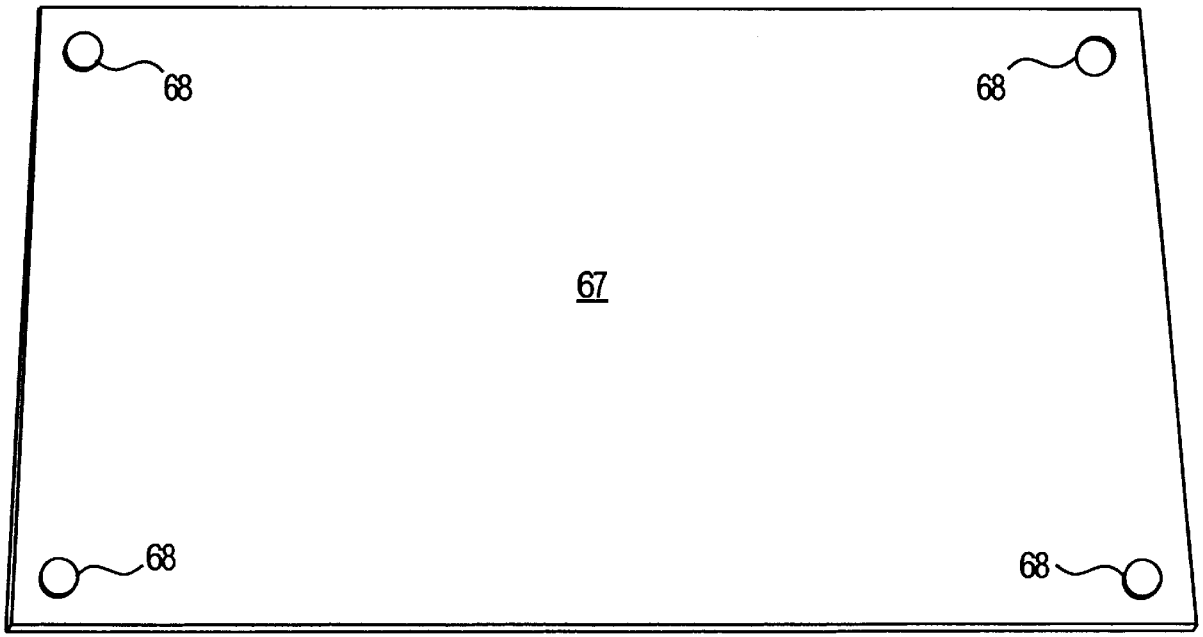
FIG. 7 is a view of the bottom plate.

FIG. 6 is a plan view of a compensations plot 70 with vertical alignment marks on a backing 65 that is normally positioned underneath the grid 66 (see FIG. 5) and held in place by plate 67 (see FIG. 7). The exact position of plot 70 depends on where one is in one's time zone, and the manner of its computation is shown below.

FIG. 7 is a view of plate 67 used to hold compensations plot 70 (see FIG. 6) in position under grid 66. Four screw holes 68 for attaching plate 67 to base 54 are also shown.

Figure 9:
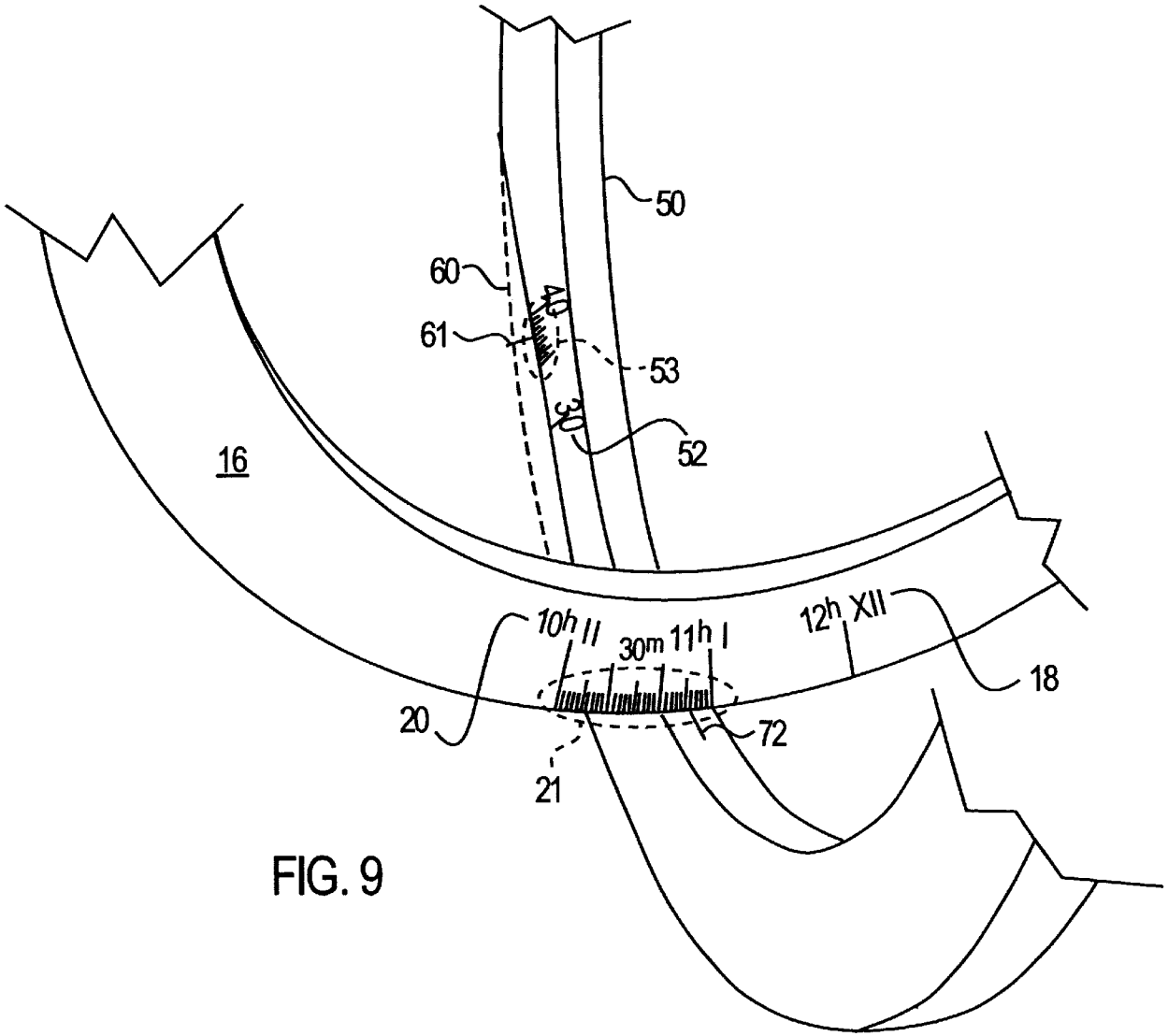
FIG. 9 is a fragmentary isometric view showing how a compensation is set or a sidereal time is read.

FIG. 8 shows the completely assembled sidereal sundial, correctly set and aligned, with ecliptic plane 24 casting its thinnest shadow on a convenient nearby surface 74 and indicating the sidereal time at the lower meridian indicator 72 (see also FIG. 9). Plate 67 has been attached to base 54 using four mounting screws 71 passing through holes 68 in plate 67 (see FIG. 7) and screwed into holes 69 in plate 54.

FIG. 9 is a close-up view indicating the two ways in which meridian indicator 72 is used. If the sidereal sundial is being used as a conventional sundial showing watch time, an appropriate compensation must be taken into consideration. FIG. 9 shows how north-facing equatorial scale 16 would be set if that day's compensation was +1 hour 8 minutes. Alternatively, if the sidereal sundial is being used to show sidereal time, the shadow cast by ecliptic plane 24 (see FIG. 8) must have been minimized 74 (again see FIG. 8), and meridian indicator 72 would then be indicating that the local sidereal time is 10:52. FIG. 9 also shows some half-degree latitude marks 53 that extend from 0 to 90° along latitude scale 52.

Theory of Operation

Sidereal time is of primary interest because it tells us how we are positioned relative to the rest of the universe, just as longitude tells us how we are positioned here on Earth relative to Greenwich. And the Earth, in fact, does not rotate 360° each solar day. Rather it rotates exactly 360° each sidereal day.

It will be easier to understand the operation of my sundial if one understands some basic concepts as taught in beginning astronomy and as often illustrated on a device called a celestial sphere. The celestial sphere, an astronomy teaching tool, is a transparent sphere representing the heavens and the apparent path of the sun amongst the stars, with the earth located in the center of this sphere. This device is used to define and illustrate many basic astronomical concepts, including the following.

North and South Celestial Poles:

To locate the north and south celestial poles, one can simply extend the axis about which the earth rotates to the north and south points on the surface of the celestial sphere.

Celestial Equator:

An imaginary plane passing through the earth's equator and extended to the celestial sphere defines the celestial equator. This plane is perpendicular to the earth's axis.

Ecliptic Plane:

The apparent yearlong path of the sun around the earth and relative to the stars is shown on a celestial sphere, complete with relevant dates. This path is referred to as the ecliptic. The plane passing through this path is referred to as the ecliptic plane, and both the path and plane are tipped up 23.4° from the equatorial plane. The sun is 23.4° north of the celestial equator on the summer solstice and 23.4° south of the celestial equator on the winter solstice.

Vernal Equinox:

The point in time and space where the sun, in its path along the ecliptic, crosses the celestial equator as it moves from the southern celestial hemisphere to the northern is called the vernal equinox or the First Point of Aries. Just as Greenwich defines 0° longitude, the vernal equinox defines 0 hours right ascension. Once around the celestial equator corresponds to 24 hours of right ascension.

Upper Meridian:

For an observer on earth, the upper meridian is the half-circle on the celestial sphere extending from the south celestial pole through the observer's zenith to the north celestial pole.

Lower Meridian:

For an observer on earth, the lower meridian is the half-circle on the celestial sphere extending from the north celestial pole through the observer's nadir to the south celestial pole.

Sidereal Time:

Sidereal time, also known as star time, equals the current right ascension of the observer's upper meridian as measured on the celestial equator.

Since the universe is so vast, we may assume that any errors incurred when we model celestial equatorial planes, ecliptic planes, and meridians in our human-scaled celestial spheres or sundials are insignificant We will also need to keep in mind the following properties of a shadow. Consider a thin plane surface with a regular or irregular edge. When any imaginable straight-line element in the given plane is pointing at the sun, that given plane will cast a thin straight line on any convenient nearby surface. Or, looking at it differently, if the given plane is oriented in such a way as to minimize the shadow it is casting, it must be that the sun is in the plane of the given plane surface.

For practical reasons, the preferred embodiment described in this patent makes use of an observer's lower meridian, but it will be much easier to understand what is going on if one first imagines the use of an observer's upper meridian.

One's local sidereal time is equal to the right ascension of one's upper meridian. Since right ascension is counted out eastward in hours from the vernal equinox along the celestial equator, one needs to know the following in order to determine one's local sidereal time:

the location of the celestial equator, the location of the vernal equinox on the celestial equator, and the right ascension of his upper meridian.

Locating the Celestial Equator

Consider one form of an equatorial sundial. The shadow caster or gnomon is a uniform rod mounted parallel to the Earth's axis, and its shadow-catching equatorial disk is mounted perpendicular to the gnomon. The equatorial disk will therefore be parallel to the plane through the Earth's equator, and for all practical purposes locates the celestial equator for us.

Locating the Vernal Equinox

Now suppose the equatorial disk of the equatorial sundial introduced above is marked once around with 24 hours of right ascension increasing in the eastward direction. Also suppose that the equatorial disk can be rotated about the gnomon. How might we orient this equatorial disk so that 0 hours right ascension correctly indicates the location of the vernal equinox?

This would be easy on the first day of spring: just rotate the equatorial disk so that an imaginary line drawn from its center to 0 hours points directly at the sun, since the sun is crossing the celestial equator and heading north on this date. On the first day of summer an imaginary line from the center of the disk to 6 hours should point 23.4° below the sun. An imaginary line through 12 hours should point directly at the sun on the autumnal equinox, and, similarly, an imaginary line through 18 hours should point 23.4° above the sun on the winter solstice. Note that in these latter three cases the vernal equinox would continue to lie in the 0 hours direction. However, this approach for locating the vernal equinox only works on those specified four days of the year.

Now suppose that the 6-hour point on the equatorial disk is tipped northward at an angle of 23.4° relative to its original position, with the line element between 0 and 12 hours as the hinge. On the equinoxes and solstices this tipped plane could also be used to locate 0 hours right ascension in much the same way it was used before being tipped. When so aligned it would be parallel to the ecliptic plane and cast thin shadows on any convenient surface. And most importantly, on any other day of the year a line from the center of this disk passing through 0 hours would be pointing at the vernal equinox if the following were true:

a) it is a day between a solstice and an equinox b) the tipped disk is rotated so that the sun's rays strike it in the quadrant defined by that solstice and equinox, and c) the shadow being cast by the disk is minimized.

The Right Ascension of One's Upper Meridian

Now imagine that the original equatorial disk and the tipped plane are both present, that they can be jointly rotated about the gnomon, and that only the equatorial disk carries the right ascension scale. Further suppose that there is an indicator of some sort that projects the location of the user's upper meridian on the right ascension scale. When the shadow has been minimized following the above procedure, the right ascension reading at the upper meridian indicator is one's local sidereal time.

In order to avoid the unnecessary shadow that would be cast by an upper meridian indicator, the preferred embodiment of my sidereal sundial uses one's lower meridian and shifts the right ascension scale around 12 hours, as shown in the figures. As a consequence, the right ascension of the vernal equinox appears to be 12 hours, not 0 hours. However, the sidereal sundial will still give the correct sidereal time, and the indicated directions of the equinoxes and solstices will still be the same.

Operation of Invention

One way of setting up my sidereal sundial initially is presented in steps A) through E). Operation of my sidereal sundial is outlined in steps F) through J).

A) Compensations plot 70 with its vertical alignment marks need only be positioned once for use at a given longitude, and it is sufficient to determine its position for just one date, February $12^{th}$ for example. If the observer was using the sidereal sundial 2.5° west of the central meridian for his time zone, this would require a longitude compensation of +10 minutes, since 360° corresponds to 24 hours. In addition, the Equation of Time for February $12^{th}$ requires a compensation of +14 minutes 14 seconds when converting sundial time to watch time, whatever the observer's longitude. Therefore the total compensation on February $12^{th}$ becomes +24 minutes 14 seconds, and compensations plot 70 should be positioned accordingly underneath grid 66, and held in that position by bottom plate 67.

B) During the fall and winter, ecliptic half-plane 24 should be mounted on the north face of equatorial disk 12 using holes 28 and aligned with reference line 44 as in FIG. 2. During the spring and summer ecliptic half-plane 24 should be mounted on the south face of equatorial disk 12 using holes 29 and aligned with reference line 42.

C) Gnomon support 50 should be rotated in groove 60 until latitude index mark 61 is directly opposite one's latitude as shown on latitude scale 52 in FIG. 8. Support 50 should then be locked in place using friction pad 64 and setscrew 62.

D) A convenient method for pointing gnomon 10 north uses a correctly set watch and the date. Determine the compensation for that day using compensations plot 70 and grid 66, and set solar/watch hours 18 on north-facing equatorial scale 16 to that compensation at meridian indicator 72, as shown in FIG. 9. Then rotate base 54 until the shadow being cast by gnomon 10 onto north- or south-facing equatorial scales 16 or 32 indicates the correct watch time, having checked that base 54 is level.

E) Gnomon 10 should now be pointing at the north celestial pole. If the user anticipates reusing this location for the sidereal sundial again sometime in the future, he can draw a line parallel to an edge of the rectangular base on the surface under the sidereal sundial.

Once the above steps have been carried out on the site(s) of interest, the remaining steps are simple and straightforward, and are the only ones regularly needed.

F) Check that ecliptic half-plane 24 is mounted as required in B) above.

G) Use leveling screws 58 and omni-directional level 56 to level rectangular base 54 and align it with the line drawn as per E) above, if necessary.

H) To obtain solar time, set XII o'clock on north-facing equatorial scale 16 to meridian indicator 72 and read the north-facing equatorial scale 16 or south-facing equatorial scale 32.

I) To obtain watch time, set in that day's compensation on north-facing equatorial scale 16 as per FIG. 9 and read north-facing equatorial scale 16 or south-facing equatorial scale 32.

J) To obtain sidereal time, rotate ecliptic half-plane 24 until its shadow 74 is thinnest on any convenient nearby surface as shown in FIG. 8 with the sun's rays coming from the correct quadrant 35, 37, 39, or 41. Then read the sidereal time on north-facing equatorial scale 16 at meridian indicator 72.

The accuracy of the local sidereal time so determined depends on the precision of manufacture, the care with which the sidereal sundial is set and aligned, and the accuracy with which one judges the sharpness of the shadow cast by the ecliptic plane. One can also check one's local sidereal time online at tycho.usno.navy.mil/sidereal.html. A sidereal sundial with a 25 cm diameter equatorial disk is capable of giving values in error by no more than ±5 minutes.

If all one seeks is the sidereal time, it is only necessary to orient gnomon 10 correctly knowing the true north-south direction, and then minimize shadow 74 of ecliptic plane 24 with due attention to the season. No compensation need be calculated. One of the many methods for determining the north-south direction without the use of a watch is to track the shadow of the tip of a vertical stick. The axis of symmetry of the curve traced out by the tip defines the north-south direction. And in the northern hemisphere, one's latitude is equal to the average altitude of Polaris as it appears to orbit the north celestial pole, and, of course, the sundial must be leveled.

Conclusions, Ramifications and Scope

As a teaching tool, my sidereal sundial reinforces an understanding of the following concepts: true north, one's latitude and longitude, the equatorial plane, the sun's path along the ecliptic, the solstices and equinoxes, the right ascension scale, solar time, the Equation of Time, one's longitude correction, watch time, and sidereal time. To the lover of sundials, it has a unique design and yields sidereal time directly and with great accuracy simply by rotating the gnomon assembly, once it has been properly set up.

While my above description contains many specificities, these should not be construed as limitations on the scope of the invention, but rather as an exemplification of one preferred embodiment thereof. Many other variations are possible. For example,

- the tilted ecliptic plane could have any planar shape or be just a band defining the edge of a flat shape: all that is important is that it cast a thinnest shadow when properly oriented and that it not interfere with the operation of the dial as a conventional sundial;
- if the base is made of an opaque material, the compensations grid and plot could appear on its upper surface or on a separate surface;
- the equatorial surface could be an equatorial ring, so long as the sun's rays could still shine on the ecliptic plane and the ecliptic plane does not interfere with the operation of the dial as a conventional sundial;

the tilted ecliptic shadow caster plane could also be well separated from the equatorial disk, as long as they rotated jointly and as long as the sidereal hours on the equatorial disk are correctly aligned with the tilted ecliptic shadow caster plane;

the complete sidereal sundial could also be permanently mounted and aligned on a post of some sort, as long as the equatorial disk and ecliptic plane could still rotate jointly;

if the sidereal sundial were elevated sufficiently, a hollow gnomon could be used so that one could view the motion of Polaris about the north celestial pole; and one could use an upper meridian mark together with a right ascension scale that had not been shifted around 12 hours if one were willing to live with an additional shadow when the dial was to be used to show solar or watch time.

Accordingly, the scope of the invention should be determined not by the embodiment illustrated, but by the appended claims and their legal equivalents.

What is claimed is:

1. A sidereal sundial comprising (a) a gnomon, (b) a support to hold the gnomon, (c) means to align said gnomon parallel with the earth's axis, (d) an equatorial disc mounted perpendicular to the gnomon and carrying sidereal time markings (1,2,3, . . . , 23,24), (e) a tipped plane mounted on the equatorial disc and making an angle of 23.4° with the equatorial disc, (f) joint rotatability of the equatorial disc and the tipped plane about the gnomon, and (g) a meridian indicator affixed to the gnomon support and adjacent to the sidereal time markings on the equatorial disc for determining the sidereal time.

* * * * *